US009015891B2

(12) United States Patent
Schaaper et al.

(10) Patent No.: US 9,015,891 B2
(45) Date of Patent: Apr. 28, 2015

(54) DEVICE AND METHOD FOR CLEANING DRINKING GLASSES

(75) Inventors: Martijn Schaaper, Monster (NL); Bauke Jan Bokma de Boer, Wassenaar (NL)

(73) Assignee: Aquafox Holdings B.V., 'S-Gravenhage (NL)

( * ) Notice: Subject to any disclaimer, the term of this patent is extended or adjusted under 35 U.S.C. 154(b) by 81 days.

(21) Appl. No.: 13/265,931

(22) PCT Filed: Apr. 26, 2010

(86) PCT No.: PCT/NL2010/050234

§ 371 (c)(1), (2), (4) Date: Nov. 29, 2011

(87) PCT Pub. No.: WO2010/123372

PCT Pub. Date: Oct. 28, 2010

(65) Prior Publication Data

US 2012/0067371 A1 Mar. 22, 2012

(30) Foreign Application Priority Data

Apr. 24, 2009 (NL) ..... 2002794

(51) Int. Cl.
*A47L 17/00* (2006.01)

(52) U.S. Cl.
CPC ..... *A47L 17/00* (2013.01)

(58) Field of Classification Search
USPC ..... 15/104.92, 210.1, 244.1
See application file for complete search history.

(56) References Cited

U.S. PATENT DOCUMENTS

| | | | | | |
|---|---|---|---|---|---|
| 1,936,259 | A | * | 11/1933 | Parmer | 15/211 |
| 2,506,075 | A | | 5/1950 | Fleury | |
| 2,556,003 | A | * | 6/1951 | Sandell et al. | 15/104.92 |
| 3,135,003 | A | * | 6/1964 | Wise | 15/244.1 |
| 3,441,970 | A | | 5/1969 | Krabal | |
| 3,913,165 | A | | 10/1975 | Behnk | |
| 4,011,621 | A | * | 3/1977 | Irvine | 15/104.92 |
| 4,811,448 | A | | 3/1989 | Yagi | |
| 5,727,275 | A | * | 3/1998 | Rocha | 15/104.92 |

FOREIGN PATENT DOCUMENTS

| | | | | |
|---|---|---|---|---|
| CH | 195618 | A | | 2/1938 |
| DE | 8915430 | U1 | | 7/1990 |
| DE | 40 09 043 | | * | 9/1991 |
| EP | 0264246 | A2 | | 4/1988 |
| FR | 763555 | A | | 5/1934 |
| FR | 1027201 | A | | 5/1953 |
| JP | 2000-271062 | | * | 10/2000 |
| JP | 2001000381 | A | | 1/2001 |

* cited by examiner

*Primary Examiner* — Randall Chin
(74) *Attorney, Agent, or Firm* — Pearne & Gordon LLP

(57) ABSTRACT

A device for cleaning drinking glasses, including inner and outer cleaning aids extending substantially upright adjacent each other to cleaningly engage an outside and an inside respectively of a wall of a drinking glass inserted between the cleaning aids. The outer cleaning aid includes at least one foam body of which a body portion, over at least a part of the height of the device, extends into a free area of a smallest circle enclosing a non-circular cross section of the inner cleaning aid.

14 Claims, 10 Drawing Sheets

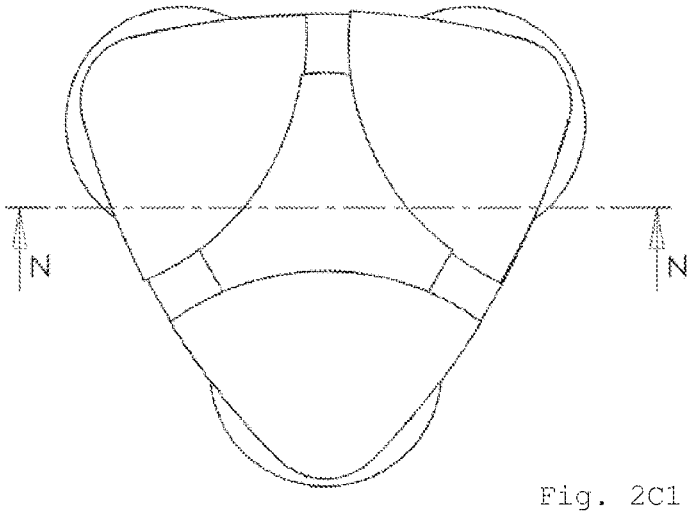
Fig. 2C1
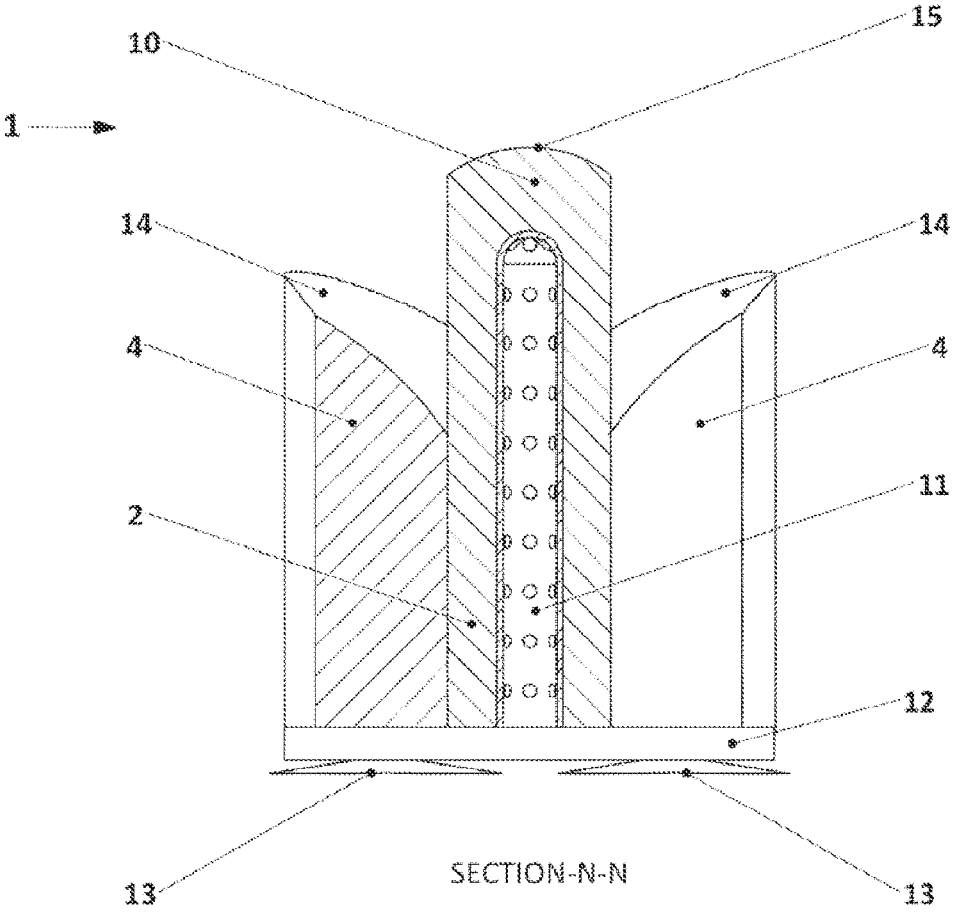
Fig. 2C2

DEVICE AND METHOD FOR CLEANING DRINKING GLASSES

BACKGROUND OF THE INVENTION

Field of the Invention and Description of Related Art

The invention relates to a device for cleaning drinking glasses. Such a device is commonly known and is used in e.g. bars and restaurants to clean the inside and outside of a drinking glass in a manual operation. The device usually comprises inner- and outer cleaning aids, usually bristles, which are immersed in a sink. In a cleaning operation, a glass is inserted between the cleaning aids, and is moved up- and down while being rotated.

In practice, however, it has proven difficult to not only rinse the glass, but to also clean off more persistent dirt and stains, for example finger marks and lipstick smudges.

In order to address this problem, a device has been proposed in U.S. Pat. No. 2,506,075 that includes bristles as inner cleaning aid, and foam pads as outer cleaning aid. In order to allow for a reliable and hygienic cleaning contact between the foam pads and the glass, a mechanism has been provided that brings the foam pads automatically in- and out of engagement with the outside of the glass during cleaning.

A disadvantage of this device is that its operation and construction are, in practice, to complex.

The invention aims at providing a device for cleaning drinking glasses that is of simple design and operation, yet with which more persistent stains and dirt may be removed in a reliable and hygienic fashion.

SUMMARY OF THE INVENTION

Thereto, the invention provides for a device for cleaning drinking glasses, comprising inner- and outer cleaning aids extending substantially upright adjacent each other to cleaningly engage an outside and an inside respectively of a wall of a drinking glass inserted between the cleaning aids wherein the outer cleaning aid comprises at least one foam body.

By arranging the cleaning aids to extend substantially upright adjacent each other, the construction of the device may be simplified. In particular, a mechanism to bring the foam body portion of the outer cleaning aid into engagement with the outside of the wall of the drinking glass may be omitted. By also arranging the foam body to extend into a circle zone that is left free due to a non-circular cross section of the inner cleaning aid, the outer cleaning aid may be compressed away from the inner cleaning aid when it is brought into contact with the outside of a wall of a drinking glass. This allows for a reliable and hygienic cleaning contact, even over a relatively large range of glass diameters. By arranging the foam body to extend into the circle zone over a substantial part of the height of the device, a relatively tall and stable contact zone may be provided. This allows both for smooth insertion and retraction of a glass, and for a stable continuous cleaning surface of the outer cleaning aid. Within the context of this application, a substantive portion of the height of the device is meant to be at least a quarter of the height, preferably at least half of the height of the device.

By disposing the inner cleaning aid as a central support for the glass, insertion and retraction of a glass may be facilitated further. Insertion and retraction of a glass may still be facilitated further by providing the cleaning aids to extend upright, and with a substantially constant or increasing cross section in the direction of insertion of a glass into the device.

By disposing the inner and outer cleaning aids such that they are substantially unbiased against each other, insertion of a drinking glass between the cleaning aids may be carried out relatively easily. In addition, the foam body of the outer cleaning element may retain its resiliency longer, and may dry more easily as it is substantially uncompressed. By providing a small gap between the inner- and outer cleaning aids, insertion of a drinking glass may be facilitated further. By disposing the inner- and outer cleaning aids such that they are biased against each other, insertion of a drinking glass may become more difficult. However, the bias may allow the foam body portion to extend towards the wall of the glass to a gap that opens up between one of the foam body portions and the wall of the glass during insertion.

By arranging the at least one foam body of the outer cleaning aid to be substantially stationarily disposed, the construction of the device may be simplified.

By providing the inner cleaning aid as at least one stationarily disposed foam body, construction and operation of the device may be simplified further. In particular, the non-circular cross section of the inner cleaning aid may, when designed as a foam body, allow for a pumping action that improves cleaning of the inside of the drinking glass.

By embodying one or more foam bodies as a reticulated foam, the foam may dry relatively easily and unwanted bacterial growth may be prevented. In addition, the open structure of reticulated foam may aid in transporting the dirt away, while the relatively rough surface of the reticulated foam structure provides for good cleaning contact. In addition, the open cell structure of the reticulated foam allows for relatively easy deformation of the foam when immersed.

A preferred foam may have a cell structure of about 15 to about 40 pores per inch, in particular about 20 to about 30 pores per inch. The tensile strength of a preferred foam may range between about 15 and about 30 psi, in particular between about 20 and about 25 psi. The density of a preferred foam may range between about 25 and about 50 kg/m3, in particular about 30 to about 40 kg/m3. By providing the foam body or bodies with a substantially constant cross section along their length, design and manufacture of the foam bodies may be made relatively simple and cost effective.

By configuring the outer cleaning aid as plurality of foam bodies that are disposed around the circumference of the inner cleaning aid, it may be achieved that the circumference of the glass may be cleaned with only a relatively small rotational movement about its axis. The device may for example comprise an outer cleaning aid that is embodied as three foam bodies that are disposed around the circumference of the inner cleaning aid at 120° intervals. The device may for example comprise an outer cleaning aid that has three foam bodies of triangular cross section, while the inner cleaning aid comprises a singular foam body of triangular cross section. The cross sections of the foam bodies may for example be the same in size.

By providing the outer cleaning aid at a free end with a taper towards the inner cleaning aid, centering of the drinking glass on the device may be facilitated.

By providing the inner cleaning aid with the free end that extends higher than the free end of the outer cleaning aid centering a drinking glass on the device may be facilitated further.

By supporting the foam body on a core, a relatively resilient foam may still be supported in a relatively stiff and reliable way.

By providing the inner and/or outer cleaning aid with a fluid supply line, cleaning of the cleaning aids themselves may be facilitated. Advantageously, the fluid supply line may be integrated in a supporting core.

The invention further relates to a kit of parts and a method for cleaning a drinking glass.

BRIEF DESCRIPTION OF THE DRAWINGS

These and further aspects of the invention are discussed further in the detailed description and are set forth in the appended claims. The invention shall be explained further with reference to a number of preferred embodiments that are shown in a drawing. In the drawings.

FIG. 2C1 shows a top view of the device of FIG. 2*a*; and

FIG. 2C2 shows a schematic side view of the device of FIG. 2C1 with a partial cross-sectional cut away taken along line N-N of FIG. 2C1.

DETAILED DESCRIPTION OF PREFERRED EMBODIMENTS OF THE INVENTION

Figure 1A:
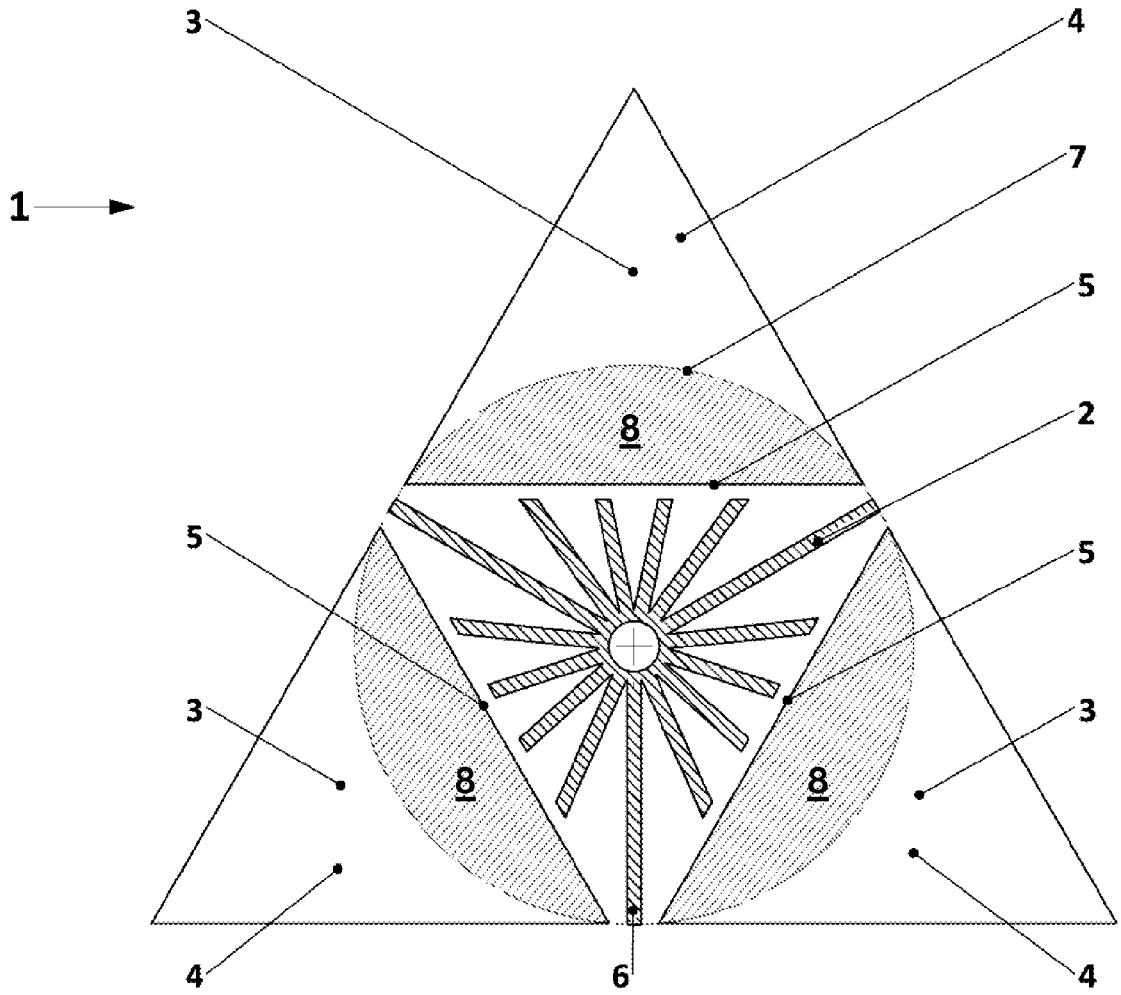
FIGS. 1*a* through 1*g* show schematic top views of devices for cleaning drinking glasses, in which the inner and outer cleaning aids have various embodiments and configurations.

The drawings are schematic representations of exemplary embodiments of the invention, and are provided as non-limiting examples. In the figures, corresponding or similar elements have been provided with the same reference numerals.

FIG. 1*a* shows a device 1 for cleaning drinking glasses. The device 1 comprises an inner cleaning aid 2 and an outer cleaning aid 3. In the cross sectional top view of FIG. 1*a*, it can be seen that the inner- and outer cleaning aids 2, 3 extend substantially upright adjacent each other. The inner- and outer cleaning aids 2, 3 are arranged to cleaningly engage an outside and an inside respectively of a wall of a drinking glass inserted between the cleaning aids 2, 3. The outer cleaning aid 3 comprises at least one substantially stationarily disposed foam body 4. With the context of the text, substantially stationary means that the foam body on portions thereof may move when a force is excerted on it, but that there is no specific mechanical mechanism provided to displace it along a predetermined path. In the embodiment of FIG. 1*a*, the outer cleaning aid 3 comprises three foam bodies 4 of equal triangular cross section that are arranged about the circumference of the inner cleaning aid 2 at 60° intervals. The triangular foam bodies 4 each face the inner cleaning aid 2 with a cleaning side 5, so that the inner cleaning aid 2 is enclosed in a triangular area. The inner cleaning aid 2 is in FIG. 1*a* embodied as a brush, of which the bristles 6 extend to form a triangular cross section. The inner cleaning aid 2 thus has a non-circular cross section.

Each foam body 4 extends into a free area of a smallest circle enclosing the non-circular cross section of the inner cleaning aid 2. The smallest circle enclosing the non-circular cross section of the inner cleaning aid 2 has been drawn into FIG. 1*a* as a dotted circle, which has been provided with reference numeral 7. The portions 8 of the foam bodies 4 that extend into the area of the smallest circle 7 have been provided with a hatching so that it may be identified more clearly in the drawing of FIG. 1*a*.

The device may be used to clean drinking glasses with a diameter smaller than circle 7 and larger than a largest auxiliary circle inscribed in the space confined between the cleaning sides 5. In order to be cleaned, a glass may be placed over the cleaning device 1 in a direction transverse to the plane of the drawing. The inner cleaning aid 2, here the bristles 6 of the brush, may engage the inside of the wall of the drinking glass that is inserted between the cleanings aids 2, 3. In addition, the outer cleaning aid 3 shall cleaningly engage the outside of the wall of the drinking glass. In particular, the body portions 8 of the foam bodies 4 shall be engaged by the rim of the glass to be compressed away from the inner cleaning aid 2. The cleaning side of portion 8 shall be moved from a position in which it extends beyond the rim towards the inner cleaning aid 2 to a position in which it extends up to the outside of the wall of the drinking glass. The drinking glass may than be cleaned by moving it up and down, i.e. towards and away from the plane of the drawing, and by rotating it about its longitudinal axis. The body portion 8 of the foam body 4 may at the location where it extends into the free space yield relatively easily, especially because the body portion 8 of the foam body 4 of the outer cleaning aid 3 is not biased against the bristles 6 of the brush of the inner cleaning aid 2.

Figure 1B:
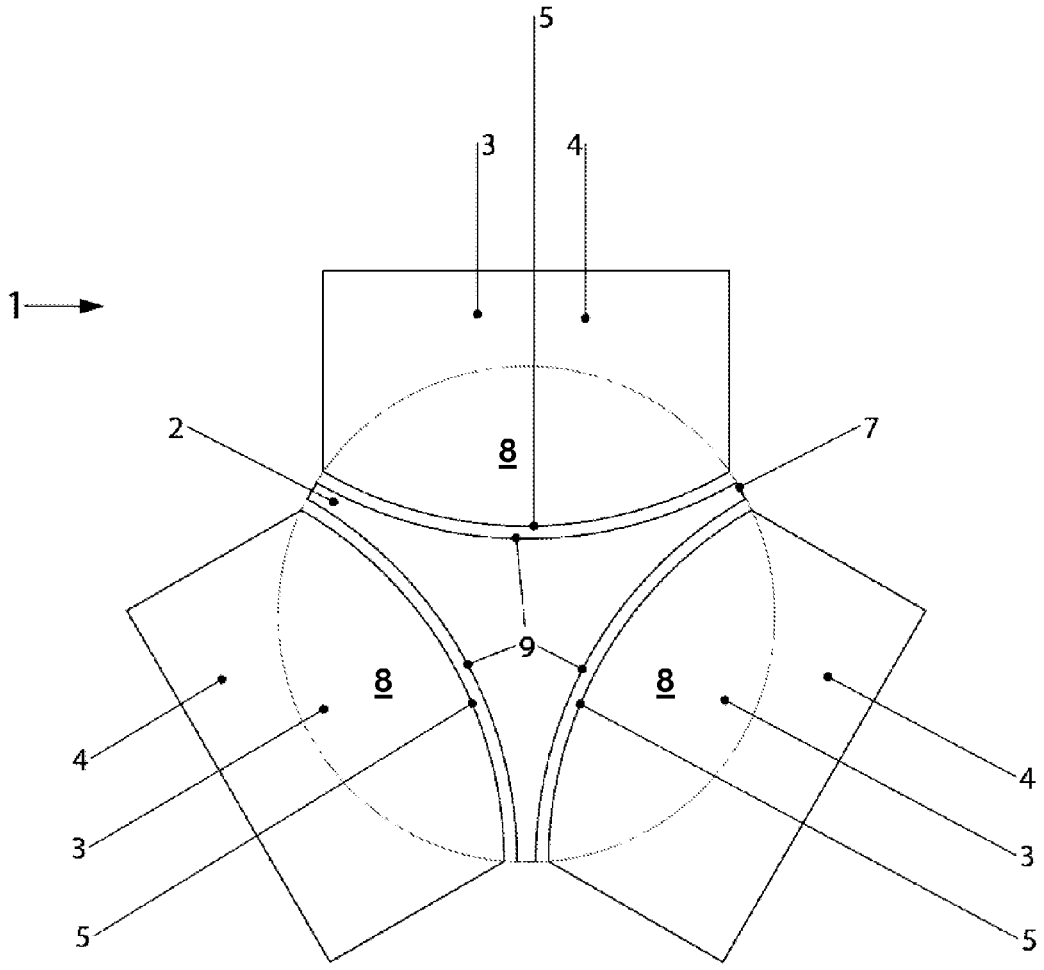

FIG. 1*b* shows another configuration of the device 1, in which the inner cleaning aid 2 is embodied as a single foam body. Here, the foam body of the inner cleaning aid 2 has been provided with concave side portions. The cleaning sides 5 of the foam bodies that face the inner cleaning aid 2 are provided with a convex shape that conforms with the concave wall. The foam bodies 4, 10 of the inner- and outer cleaning aids may abut against each other, or may leave a gap therebetween. As an alternative, the foam bodies 4, 10 of the inner- and outer cleaning aids may be biased against each other.

Figure 1C:
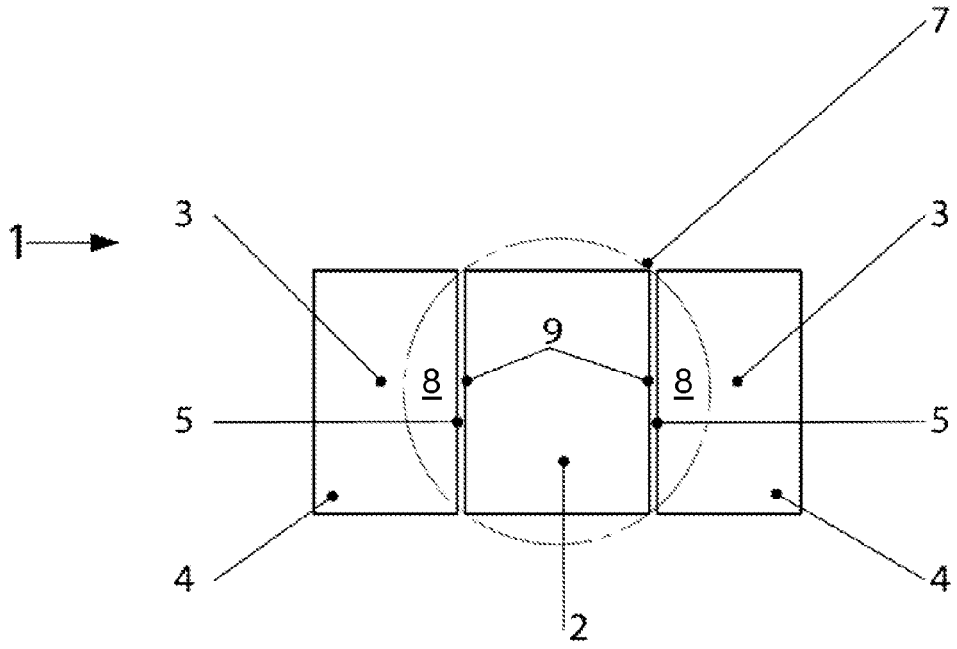

In FIG. 1*c* a simplified configuration has been shown, in which a square or rectangular foam body 4 of an inner cleaning aid 2 is flanked by two rectangular foam bodies 4 that form an outer cleaning aid 3. As a further simplification, one of the foam bodies 4 of the outer cleaning aid 3 may be omitted. However, this would require turning the glass further about its axis in order to clean the full outer circumference.

Figure 1D:
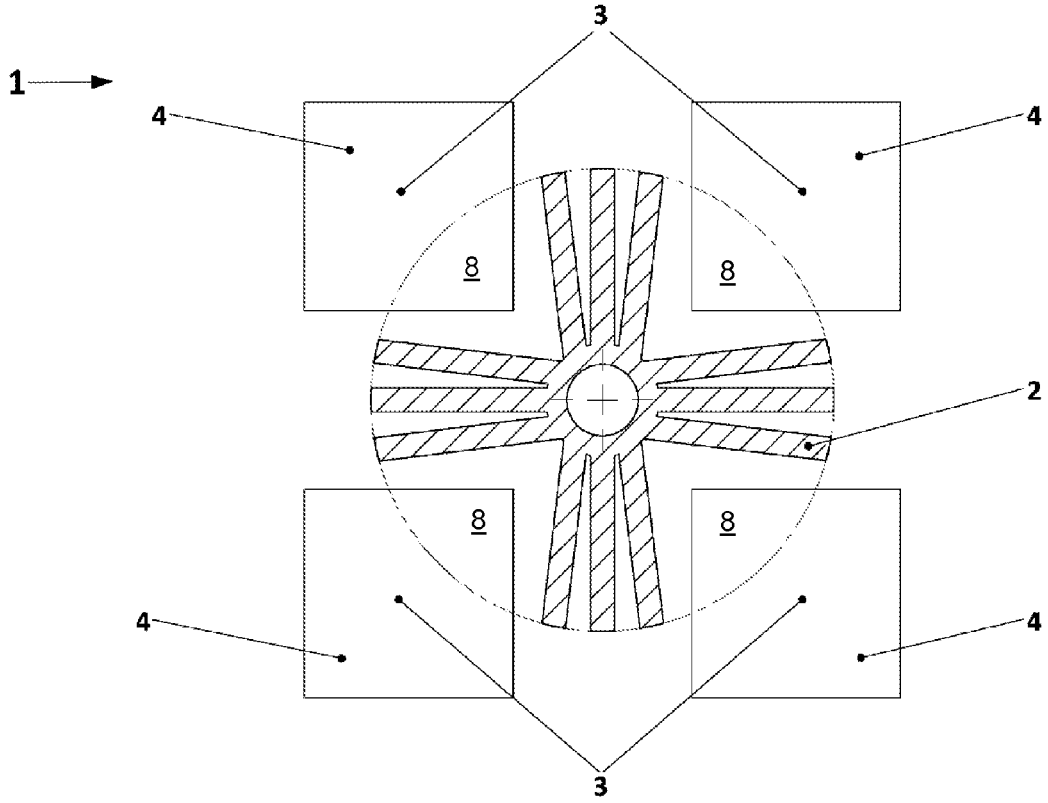

FIG. 1*d* shows yet another embodiment including an outer cleaning aid 3 that is composed of four foam bodies 4 of square cross section, of which the corners extend radially between tufts of hairs 11 of a cross-shaped brush that forms the inner cleaning aid 2.

Figure 1E:
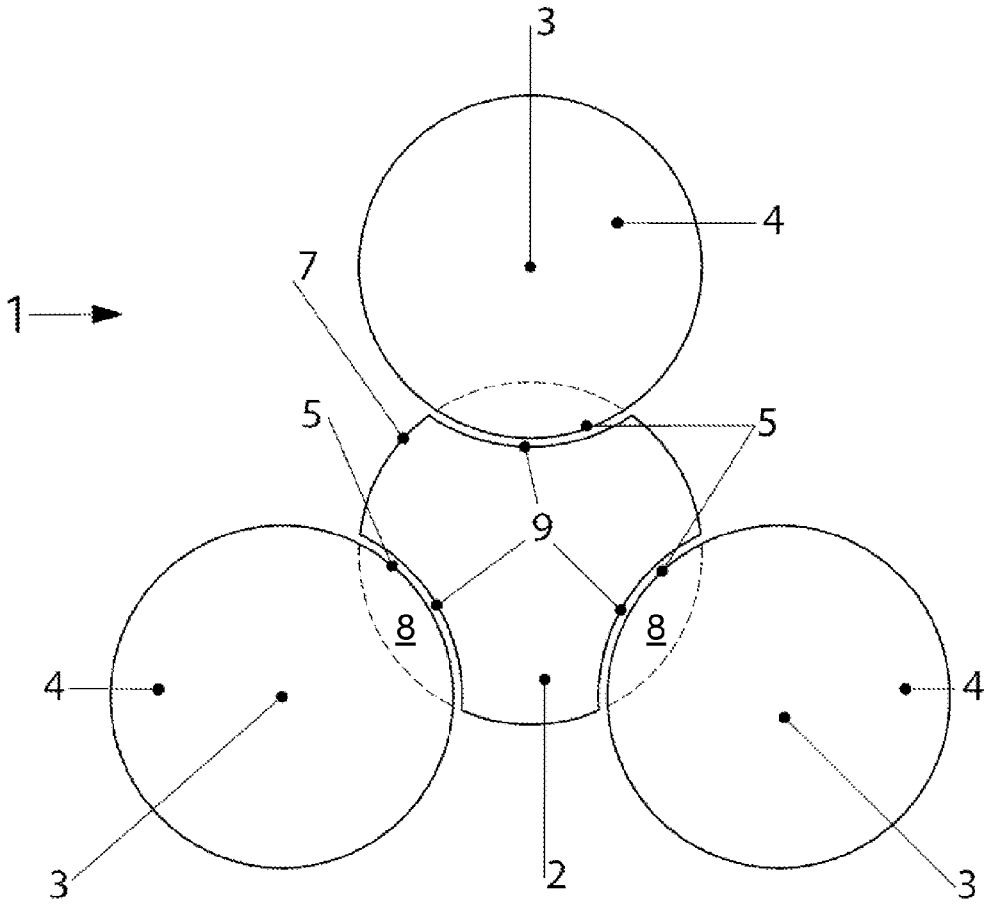

FIG. 1*e* shows an embodiment that is similar to the embodiment of FIG. 1*b*, but in which the foam bodies 4 have been provided with a circular cross section.

Figure 1F:
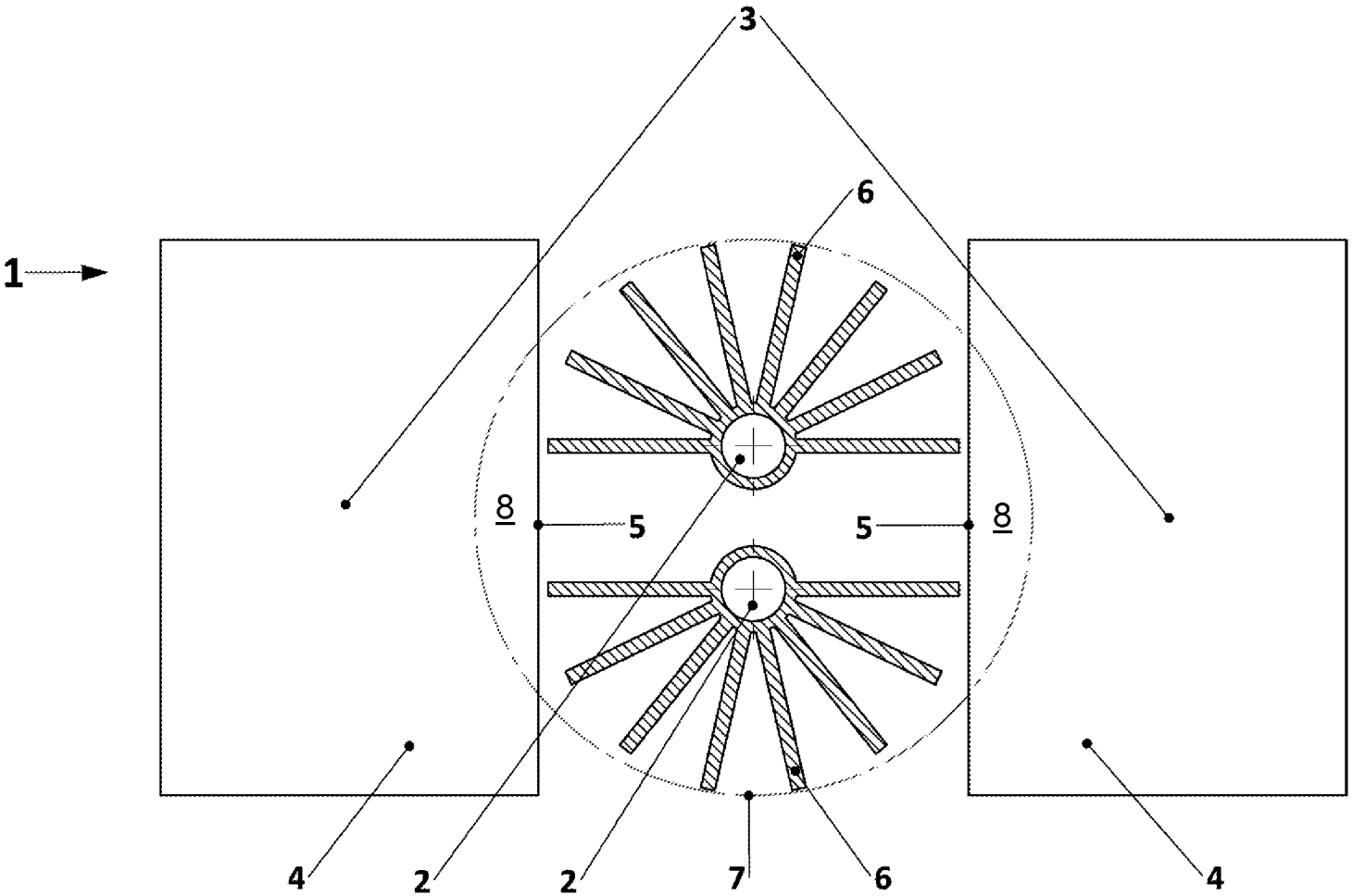

FIG. 1*f* shows yet another embodiment in which the inner cleaning aid 2 is built up of two half cylindrical brushes that are spaced apart, and which are flanked by two foam bodies 4 of rectangular cross section that form the outer cleaning aid.

Figure 1G:
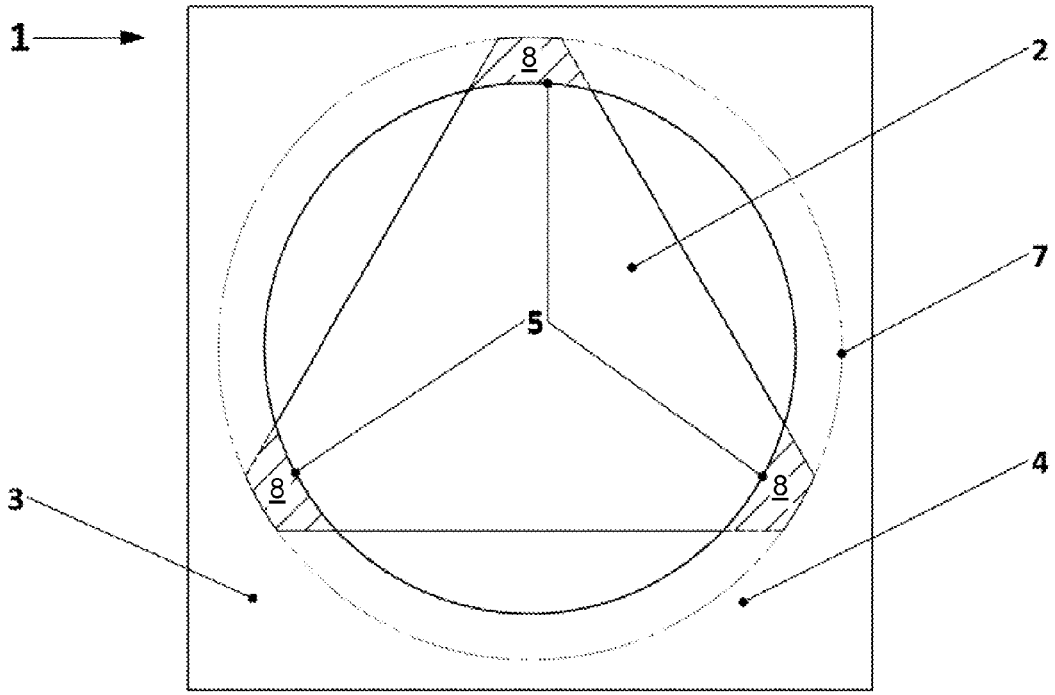

FIG. 1*g* shows a further embodiment in which the device 1 comprises an inner cleaning aid 2 and an outer cleaning aid 3. In the cross sectional top view of FIG. 1*g* it can be seen that the inner- and outer cleaning aids 2, 3 extend substantially upright adjacent each other. The inner- and outer cleaning aids 2, 3 are arranged to cleaningly engage an outside and an inside respectively of a wall of a drinking glass inserted between the cleaning aids 2, 3. The outer cleaning aid 3 comprises a single foam body 4 in which a cylindrical aperture has been provided having a constant cylindrical cross section. The inner cleaning aid 2 is embodied as a single foam body having a triangular cross section that has been inserted into the cylindrical aperture. To accommodate a relatively large range of glasses, the inner cleaning aid 2 and the outer cleaning aid may be biased against each other, for example by arranging the cylindrical foam body and the cylindrical aperture to engage each other with a press fit or an interference fit. In the embodiment of FIG. 1*g* this has been illustrated by the tips of the inner cleaning aid that reach into the foam body 4.

Figure 2A:
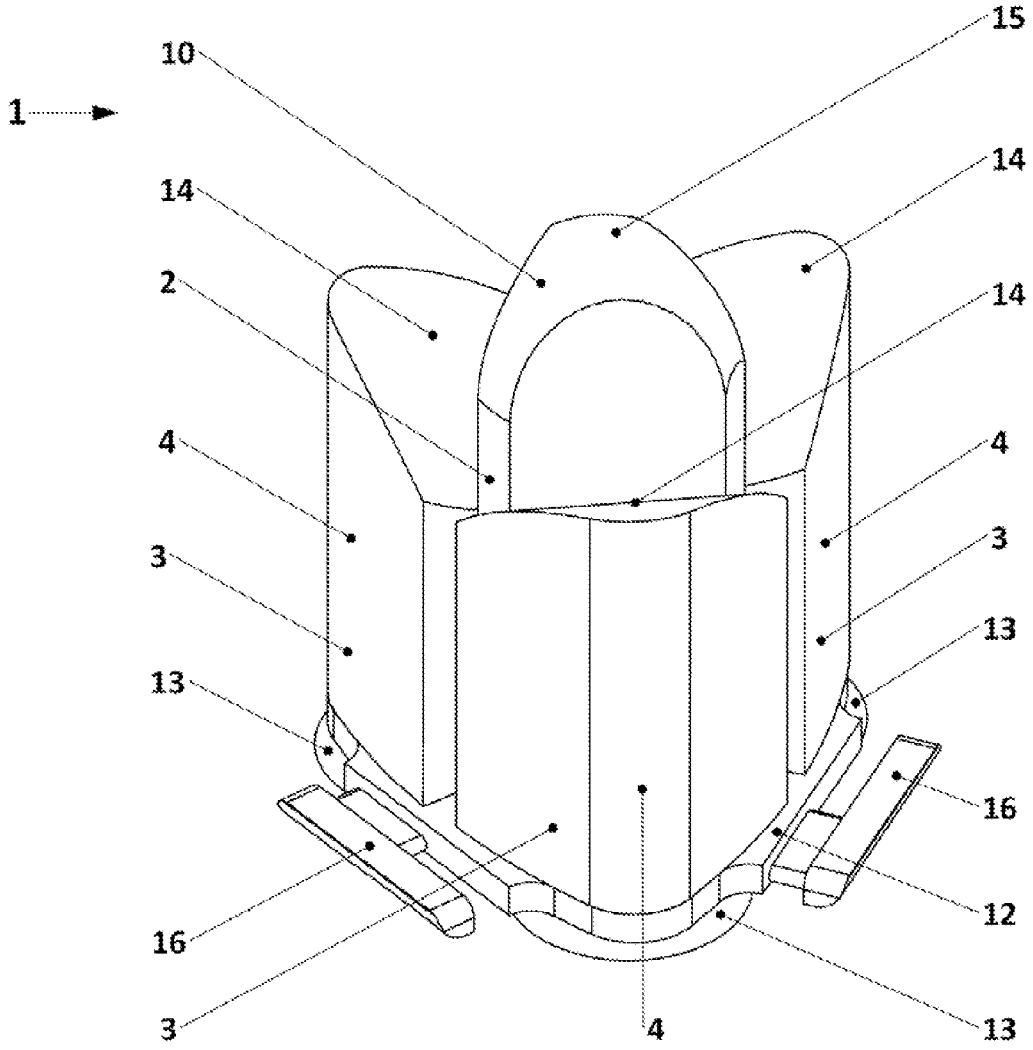
FIG. 2*a* shows a schematic perspective view of a preferred embodiment of a device for cleaning drinking glasses.

FIGS. 2*a*-2C2 show a preferred embodiment of the device 1 for cleaning drinking glasses, which comprises a foam body 10 of non-circular cross section as inner cleaning aid 2. The outer cleaning aid 3 comprises three foam bodies 4 of substantially triangular cross section. The inner- and outer cleaning aid 2, 3 extends substantially upright adjacent each other to cleaningly engage an inside and an outside respectively of a wall of a drinking glass that is inserted between the cleaning aids 2, 3. The foam bodies 4, 10 of the outer and inner cleaning aid 2, 3 are substantially stationarily disposed. In particular, the foam bodies 4, 10 are each supported on a core 11, which core 11 in turn is supported on a triangular base plate 12. The base plate 12 is at its corners provided with suction pads 13 to engage the bottom of the sink. The foam body of the inner cleaning aid 2 has a non-circular cross section and is supported on a hollow core 11, which may double as a fluid supply line. The foam bodies 4 of the outer cleaning aid 3 comprise body portions 8 which, over a substantial portion of the height of the device, extend into a free area of a smallest circle 7 enclosing the non-circular cross section of the inner cleaning aid 2.

The foam bodies may for example be made of a reticulated foam, having an (open) cell structure of about 25 pores per inch, a tensile strength of about 25 psi and a density of about 35 kg/m3. The foam bodies 4, 10 have a substantially constant cross section along their length. The foam bodies 4 are disposed around the circumference of the inner cleaning aid 2. The foam bodies 4 of the outer cleaning aid 3 extend up to the foam body 10 of the inner cleaning aid 2, and have respectively a convex and a concave adjacent surface 5, 9. The foam bodies 4, 10 are not biased against each other. The foam bodies are at their body portions 8 therefore undeformed. The adjacent surfaces 5, 9 of the foam bodies 4 of the outer cleaning aid 3 and the foam body 10 of the inner cleaning aid 2 may here for example abut against each other, or may for example be lightly biased against each other.

The foam bodies 4 of the outer cleaning aid 3 taper towards the inner cleaning aid 2 at their free ends 14. In addition, the foam body 10 of the inner cleaning aid 2 has a free end 15 that extends higher than the free ends of the foam bodies 4 of the outer cleaning aid 3, and which is shaped as a dome.

The device 1 may be attached to the bottom of a sink, so that it is immersed in cleaning fluid (usually water with a small amount of cleaning agent).

Figure 2B:
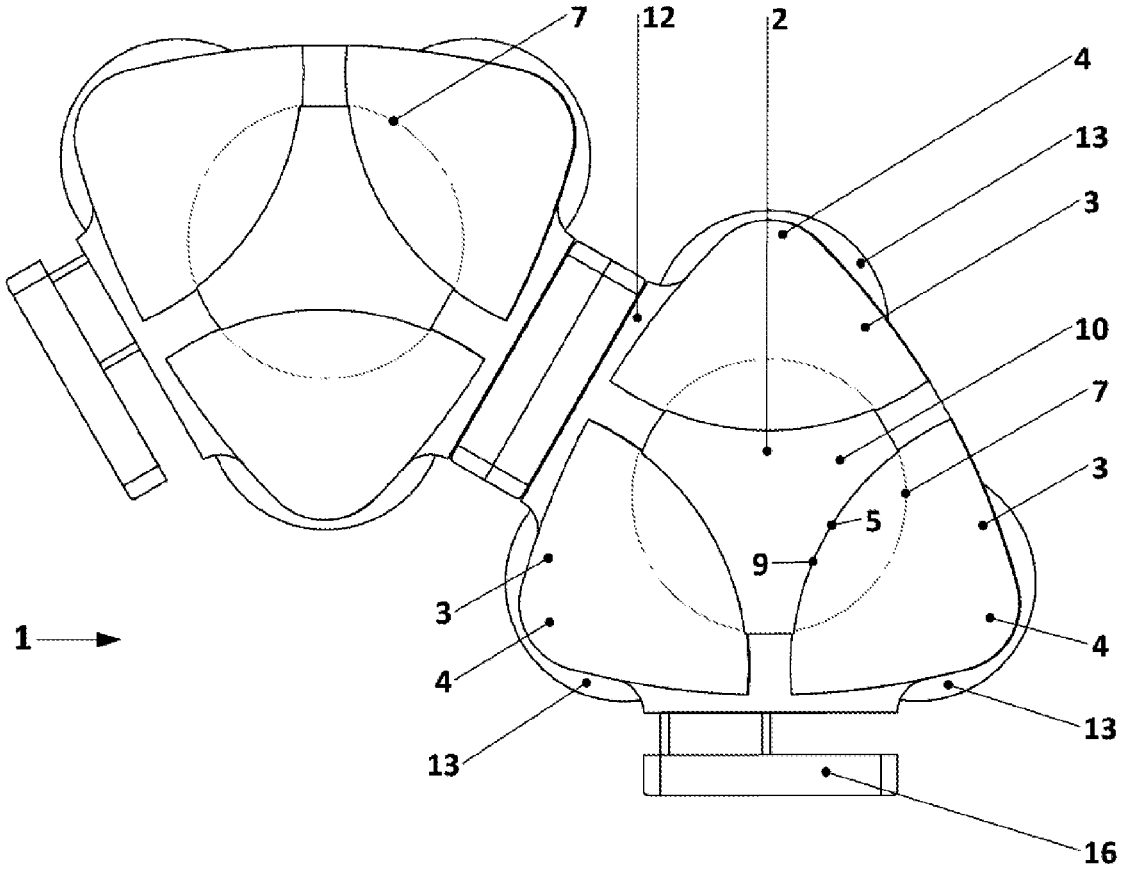
FIG. 2*b* shows a top view of the device of FIG. 2*a* placed alongside an identical device.

As may taken from FIG. 2*b*, several cleaning devices may be juxtaposed. A tab 16 extending from the base plate 12 may be used to interconnect the devices 1.

In operation a glass to be cleaned is placed with its open end over the domed free end 15 of the inner cleaning aid 2, and is pressed downward while being centered by the tapered free ends 14 of the foam bodies 4 of the outer cleaning aid 2. Next the wall of the glass (not shown) may be introduced between adjacent inner and outer cleaning aids 2, 3 to cleaningly engage an inside and an outside respectively of a wall of drinking glass. Upon insertion, a foam body portion 8 of the outer cleaning aid 3 may be engaged by the rim of the glass to be compressed away from the inner cleaning aid 2 towards the outer cleaning aid 3. The foam body portion 8 may thereby be compressed from a position in which it extends beyond the rim of the glass towards the inner cleaning aid 2, to a position in which it extends up against the outside of the wall of the glass.

Subsequently, the glass may be moved up and down along its axis, while it may also be rotated about its axis. The foam bodies 4 of the outer cleaning aid 3 then sweep the outside of the wall of the drinking glass, while the edges of the foam body 10 of the inner cleaning aid 2 sweep the inside of the wall of the drinking glass. Due to the non-circular circumference of the inner cleaning aid and the open nature of the reticulated foam, the foam body 10 of the inner cleaning aid 2 provides for a pumping action that ensures a good flow of cleaning liquid inside the glass.

Subsequently, the glass may be removed from the cleaning device 1.

It shall be noted that the invention is not limited to the embodiments describes herein. The skilled person shall realize that many variations are possible within the scope of the invention as defined by the appended claims.

The invention claimed is:

1. A device for cleaning drinking glasses, comprising inner and outer cleaning aids extending substantially upright adjacent each other to cleaningly engage an inside and an outside respectively of a wall of a drinking glass inserted between the cleaning aids, wherein the outer cleaning aid comprises at least one foam body, wherein a body portion of the at least one foam body, over at least a part of the height of the device, extends into a free area of a smallest circle enclosing a non-circular cross section of the inner cleaning aid.

2. The device according to claim 1, wherein the body portion of the at least one foam body is arranged to extend into the circle area over a substantial part of the height of the device.

3. The device according to claim 1, wherein the inner cleaning aid comprises at least one stationarily disposed foam body.

4. The device according to claim 1, wherein the at least one foam body comprises a reticulated foam.

5. The device according to claim 1, wherein the at least one foam body has a substantially constant cross section along its length.

6. The cleaning device according to claim 1, wherein the outer cleaning aid comprises a plurality of foam bodies disposed around the circumference of the inner cleaning aid.

7. The device according to claim 1, wherein the outer cleaning aid at a free end tapers towards the inner cleaning aid.

8. The device according to claim 1, wherein the inner cleaning aid has a free end that extends higher than a free end of the outer cleaning aid.

9. The device according to claim 1, wherein the at least one foam body is supported on a core.

10. The device according to claim 1, wherein the inner and/or outer cleaning aid is provided with a fluid supply line.

11. The device according to claim 1, wherein the at least one foam body of the outer cleaning aid is substantially stationarily disposed.

12. The device according to claim 1, wherein the inner cleaning aid is disposed as a central support for a drinking glass.

13. The device according to claim 1, wherein the body portion of the at least one foam body is arranged to extend into the circle area over at least a quarter of the height of the device.

14. The device according to claim 1, wherein the body portion of the at least one foam body is arranged to extend into the circle area over at least half of the height of the device.

* * * * *